US006352214B1

(12) United States Patent
Wild et al.

(10) Patent No.: US 6,352,214 B1
(45) Date of Patent: Mar. 5, 2002

(54) METHOD FOR IDENTIFYING THE SPINNING POSITION OF A COP

(75) Inventors: Urs Wild, Hinwil; Christian Hunziker, Grut; Heinrich Scherer, Baretswil; Zdenek Mazura, Kaltbrunn, all of (CH)

(73) Assignee: Gebruder Loepfe AG (CH)

( * ) Notice: Subject to any disclaimer, the term of this patent is extended or adjusted under 35 U.S.C. 154(b) by 0 days.

(21) Appl. No.: 09/571,957

(22) Filed: May 16, 2000

(30) Foreign Application Priority Data

May 25, 1999 (CH) ..... 0968/99

(51) Int. Cl.[7] ..... B65H 49/00; B65H 75/12; D01H 13/26

(52) U.S. Cl. ..... 242/474; 242/118.32; 57/265; 57/281

(58) Field of Search ..... 242/474, 474.1, 242/118.32; 57/281, 265

(56) References Cited

U.S. PATENT DOCUMENTS 3,263,499 A * 8/1966 Gith et al. ..... 242/118.32 X
4,660,370 A * 4/1987 Matsui et al. ..... 57/281
4,838,019 A * 6/1989 Ueda ..... 57/265 X
4,940,127 A 7/1990 Kikuchi et al.
5,100,073 A * 3/1992 Moehrke et al. ..... 57/281 X
5,107,667 A * 4/1992 Tone et al. ..... 57/281 X
5,287,692 A * 2/1994 Matsubayashi ..... 57/281
5,289,983 A * 3/1994 Ueda et al. ..... 57/281 X
5,359,160 A * 10/1994 Wirtz ..... 57/281 X

FOREIGN PATENT DOCUMENTS

| | | |
|---|---|---|
| DE | 3732367 | 11/1988 |
| DE | 3733511 | 4/1989 |
| DE | 3911799 | 10/1990 |
| DE | 4306095 A1 | 10/1993 |
| EP | 0342527 | 11/1989 |
| EP | 0392249 | 10/1990 |
| EP | 0 593 808 | 4/1994 |
| GB | 1032731 | 6/1966 |
| GB | 1035682 | 7/1966 |

OTHER PUBLICATIONS

European Search Report.

* cited by examiner

*Primary Examiner*—Michael R. Mansen
(74) *Attorney, Agent, or Firm*—Harness, Dickey & Pierce, P.L.C.

(57) ABSTRACT

In a method for identifying the spinning position of cops, each cop is provided with an individual marker. The marker is read at the rewinding machine for determining the corresponding spinning position. The marker can e.g. consist of a bar code applied to an end of the cop's tube. With this system it becomes easy to attribute yarn parameters determined at the rewinding machine to individual spinning positions.

4 Claims, 3 Drawing Sheets

METHOD FOR IDENTIFYING THE SPINNING POSITION OF A COP

CROSS REFERENCE TO RELATED APPLICATIONS

This application claims the priority of Swiss patent application 0968/99, filed May 25, 1999, the disclosure of which is incorporated herein by reference in its entirety.

BACKGROUND OF THE INVENTION

The invention relates to a method for identifying the spinning position of a cop.

In spinning mills, the spun yarn is wound into cops. Modern spinning machines can e.g. have between 600 and 1500 spinning positions for winding a corresponding number of cops in parallel.

From the spinning machines, the cops are transported to rewinding machines, where the yarn is transferred from the cops to larger bobbins while it is classified and cleaned at the same time.

The classification of the yarn, which is carried out in the rewinding machines, yields information on the yarn's quality. If defective yarn is found, it is desired to identify the spinning position where this yarn has been produced, such that the problem can be removed.

In order to identify the spinning position, it has been proposed to transport the cops from the spinning machine to the rewinding machine by means of caddies or pucks, wherein the caddies comprise a memory where the spinning position is stored. This is, however, an expensive solution.

As follows from the above, the term "cops" designates a carrier, such as a tube, with yarn wound thereon, as it is produced in the spinning position. Such cops are also termed "spinning bobbins".

The term bobbin designates the wound up yarn as produced by the rewinding machine. Such bobbins are also designated as "yarn packages".

BRIEF SUMMARY OF THE INVENTION

Hence, it is a general object of the invention to provide a method for identifying the spinning position of the cop in simple and efficient manner.

Now, in order to implement these and still further objects of the invention, which will become more readily apparent as the description proceeds, the method for identifying a spinning position of cops, wherein a yarn is wound on each cop in one of a plurality of spinning positions and unwound in a rewinding machine, comprises the steps of providing each cop with an individual marker and reading said marker at said rewinding machine for identifying defective spinning positions.

In a further aspect of the invention, the method for identifying a spinning position of cops, wherein each cop is wound in one of a plurality of spinning positions and unwound in a rewinding machine, comprises the steps of providing each cop with an individual marker and reading said marker after unwinding said cop for identifying defective spinning positions.

Hence, each cop is provided with a marker that can be used for identifying its spinning position. This marker can be read at the rewinding machine and/or after unwinding the cop. Hence, no special caddies or other means are required for identifying the spinning position. This is especially useful in cases where the spinning machine and the rewinding machine are not operating in-line and the cops are transported in unordered manner from the spinning machine to the rewinding machine.

The marker can in particular be applied to the tube of the cop or to the yarn of the cop.

If the marker is applied to the tube, it can e.g. consist of a bar code. This bar code should preferably be readable along a direction transversally to the longitudinal axis of the tube because less space is available parallel to this axis. The bar code can e.g. be repeated at least three times, preferably five times, along the circumference of the tube, so that it can be read out without rotating the cop.

Since the available space for applying the bar code is limited, the bar code should be short. If identification numbers of n bits are used and each bit is encoded as a narrow or wide bar code section, then the allowable identification numbers should be limited to a subset of all possible n-bit numbers. The subset is defined by those numbers that are encoded in bar codes with at least a given number k of narrow sections, wherein $k>0$.

The marker can also be written magnetically into the tubes of the cops, preferably by using cops having a tube comprising magnetizable particles.

The marker can also be generated by dyeing the yarn, in particular by dyeing an end section of the yarn.

In an especially simple embodiment, each tube is provided with an individual marker. For identifying the spinning position of the tubes, a list is maintained separate from the tubes, e.g. in a computer, by reading the marker at each spinning position. This dispenses with the need for rewriting each marker at the spinning positions.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
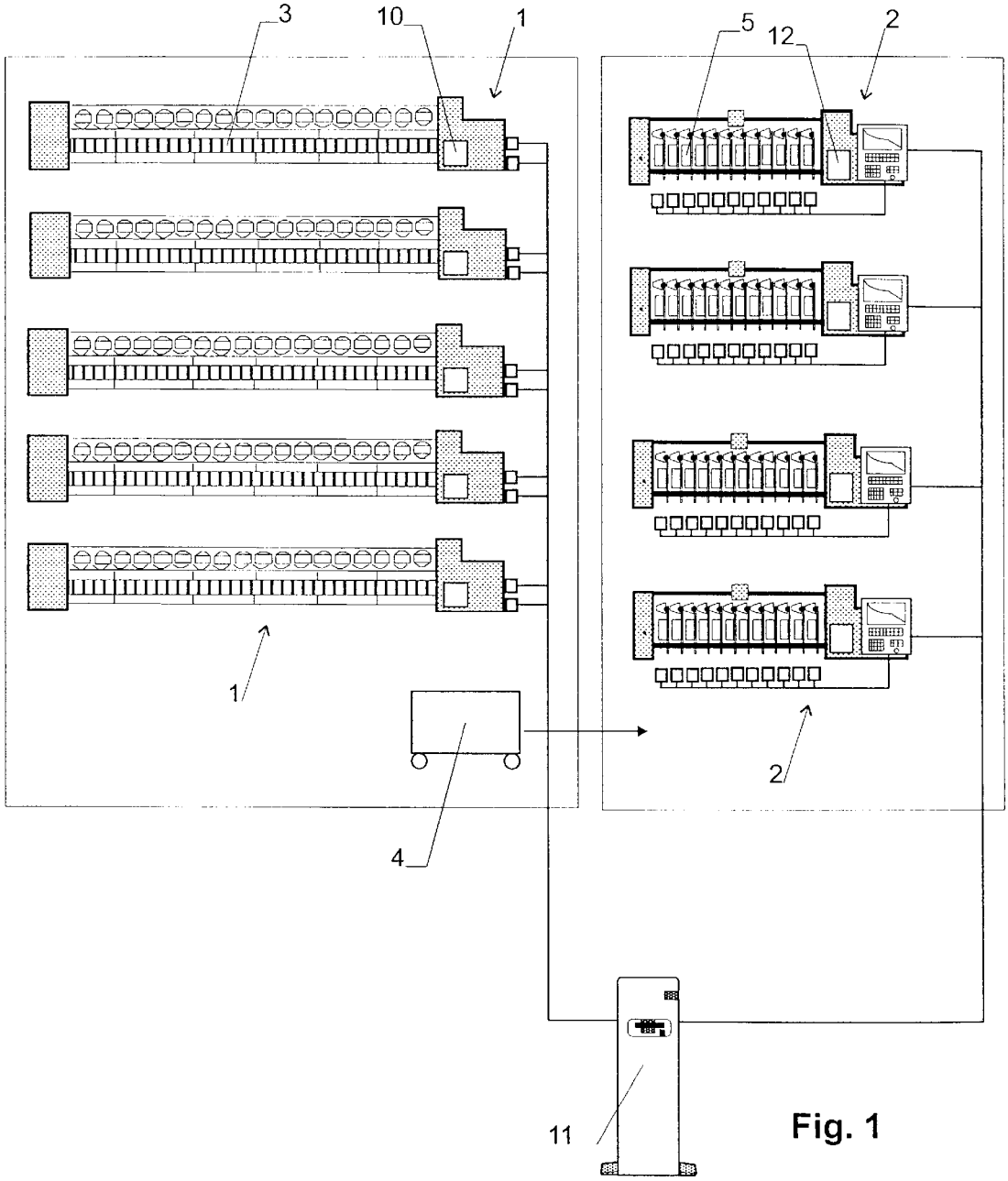
FIG. 1 is a block diagram of a spinning and rewinding plant.

FIG. 1 shows a plant with several spinning machines 1 and several rewinding machines 2.

Each spinning machine 1 comprises a plurality of spinning positions 3, e.g. approximately 1000. In each spinning position 3, yarn is wound onto one cop. The wound cops are automatically transferred to containers 4.

The containers 4 are wheeled to the rewinding machines 2. Each rewinding machine comprises a plurality (e.g. 100) of rewinding locations 5 for transferring the yarn from the cops to larger bobbins. At the same time, the yarn is classified and, if necessary, cleaned. In particular, sections with too thick or thin diameters or other yarn faults are counted for deriving information about the yarn's quality.

After unwinding, the empty cores or tubes of the cops are removed from their rewinding location and brought back to the spinning machines 1, where they are re-wound with new yarn.

Since a poor quality of the yarn is often due to an inappropriate adjustment of the operating parameters of the corresponding spinning position 3, it is desired to attribute the quality of the cops determined in the rewinding locations to the individual spinning positions. If, for example, it has been found that yarn of a certain spinning position is of poor quality, this spinning position can then be readjusted.

For attributing the cops to the spinning positions 3, the core or tube of each cop is provided with a marker. Depending on the nature of the marker, additional reading and/or writing devices are required. This is described in the following.

Figure 2:
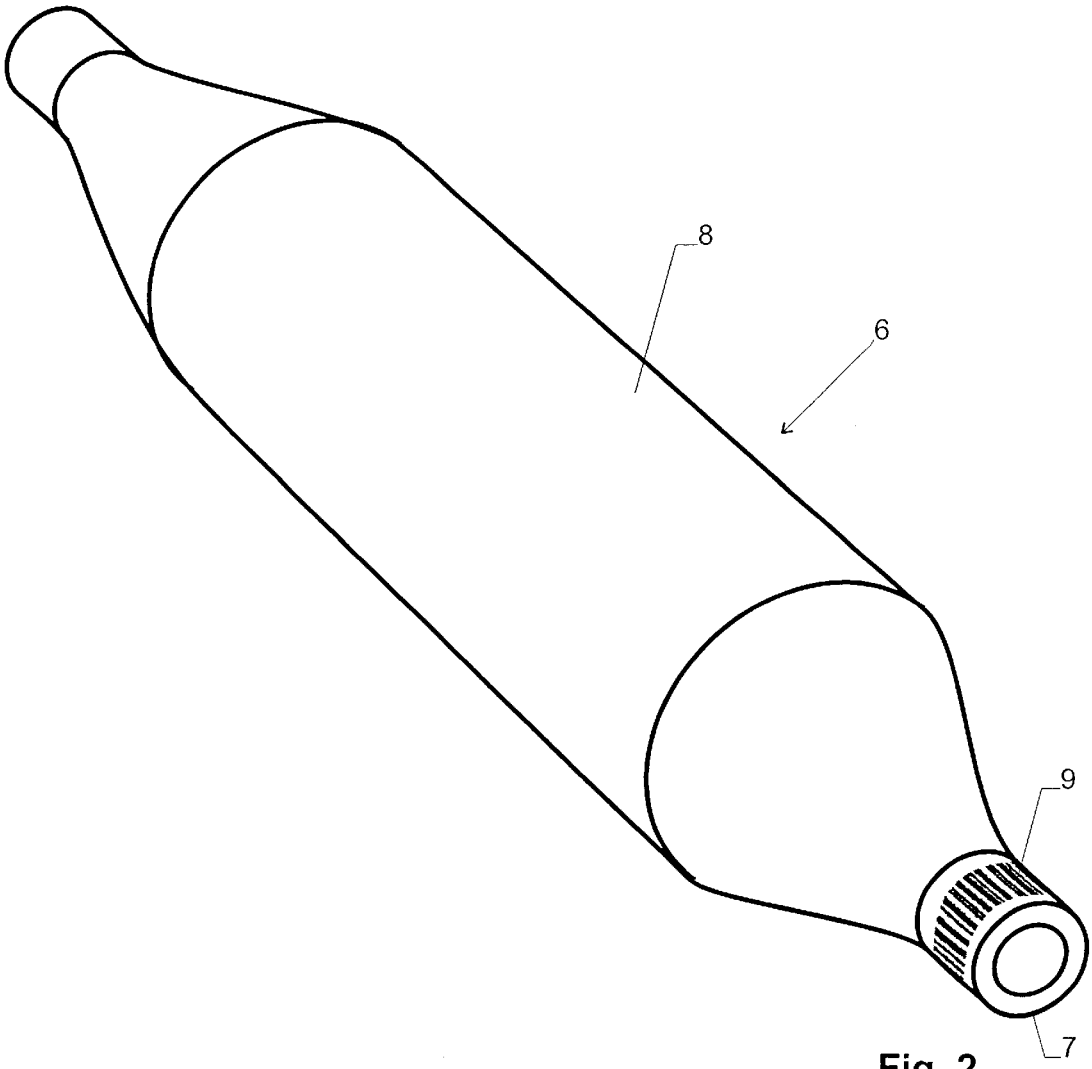
FIG. 2 is a cop with a bar code marker.

FIG. 2 shows an individual cop 6 having a tube 7 of plastic yarn 8 wound thereon. In the present context, the expression "tube" is to designate any core of a cop, be it hollow or not. For identifying the cop, a marker 9 is arranged at an end of tube 7.

In a first embodiment of the invention, marker 9 consists of a bar code representing an individual identification number attributed to the cop. This identification number differs from cop to cop and is permanently affixed to tube 7.

For this embodiment of the cop, reader devices 10 are arranged in the spinning machines, by means of which the identification number is read before each empty tube is fed to one of the spinning positions 3 or after it has been wound with yarn. The corresponding data (identification number of the cop and identity of the spinning positions where the cop is wound) are fed to a central computer 11 and stored therein in a table. This table keeps record of the latest spinning position of each cop.

Further reader devices 12 are arranged at the rewinding machines 2 for reading the identification number of each cop before it is fed to one of the rewinding locations 5 or after rewinding has taken place. The information (identification number of the cop and identity of the rewinding location) is stored in the same or another table in central computer 11.

Finally, the cleaning and classification detectors of the individual rewinding locations also transfer the quality data of each cop to central computer 11, where they can be attributed to a given cop and therefore to the corresponding spinning position 3.

In the embodiment of FIG. 2, marker 9 is a bar code. It is preferably applied to the tube by the manufacturer of the tubes and is not modified by the operator of the spinning and rewinding machines.

For being able to read the bar code without rotating the cop, it is preferably repeated at least three times around the circumference of the tube. Preferably, the bar code is even repeated four or five times around the tube for reducing the requirements to be met by the imaging optics of the reader.

Figure 3:
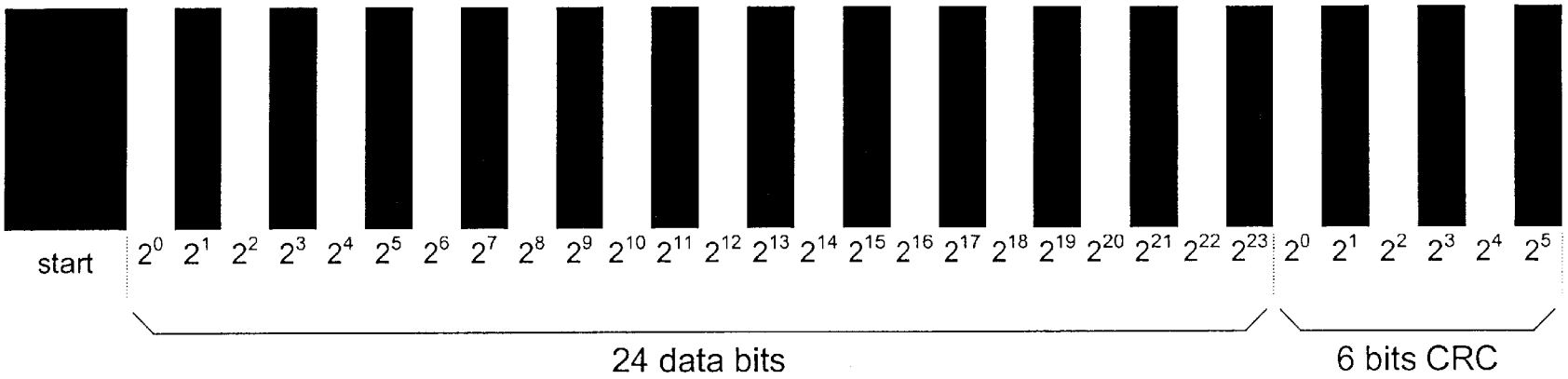
FIG. 3 illustrates the encoding of the bar code.

In a preferred embodiment, an encoding is used such as it is e.g. shown in FIG. 3. The bar code comprises 32 sections separated by transitions between light and dark areas. Each section has a width at least equal to a unit width E of e.g. 0.3 mm.

The first section has a width 4E and marks the start of the code. The following n=24 sections correspond to the 24 bits of the identification number of the cop and have a width of either 1E or 2E, depending on if the corresponding bit has the value 1 or 0. Then, there follows a CRC checksum consisting of six bits, followed by an end mark (a white section) with a length of at least 1E.

For limiting the total length of the bar code to e.g. 16 mm, not all possible numbers between 0 and $2^{24}-1$ are admitted as identification numbers. Rather, only those numbers are allowed that have at least k=11 sections of a length of 1E only.

Instead of the marker shown in FIGS. 2 and 3 with a bar code, tube 7 can also be marked in any other manner. For example, the bar code can e.g. be applied to an inner side of the tube or be formed by a surface relief on the tube. It is also possible to apply a magnetic strip to the cops for storing the identification number.

In a further preferred embodiment, tube 7 is made from a magnetizable material. For example, it is made from a plastic comprising particles of magnetizable material suspended therein.

It is also possible to locate a semiconductor chip in the tube, the data of which can e.g. be read out or modified inductively in wireless manner.

In the embodiments described so far, each cop 6 has its own identification number, which it maintains over several winding and unwinding cycles. This makes it necessary to store the tables mentioned above in central computer 11 for attributing the quality data to individual spinning positions. It is, however, also possible to mark each cop after each new winding and unwinding cycle anew, in which case the marker preferably identifies the corresponding spinning position directly.

For this purpose, a writing device can be arranged at the spinning machines instead of reader device 10 for storing the spinning position on the cop. In this case, the marker can e.g. be a magentic medium or it can be a removable and/or rewritable a bar code.

Figure 4:
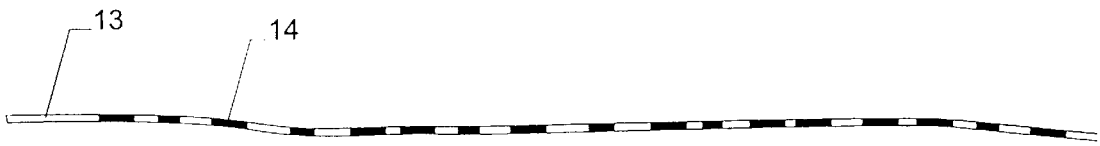
FIG. 4 shows the end section of a yarn with a marker.

In a further preferred embodiment, yarn 8 is marked instead of tube 7. As shown in FIG. 4, the end 13 of the yarn can e.g. be dyed with marks 14 that can be encoded like a bar code. The advantage of this embodiment lies in the fact that no separate reader devices 12 are required for the bar code since the dye marks 14 can also be read by the detectors of the classifiers.

While there are shown and described presently preferred embodiments of the invention, it is to be distinctly understood that the invention is not limited thereto but may be otherwise variously embodied and practised within the scope of the following claims.

What is claimed is:

1. A method for identifying a spinning position of cops, wherein a yarn is wound on each cop in one of a plurality of spinning positions and unwound in a rewinding machine, comprising the steps of:

generating, on each cop, an individual marker by dyeing said yarn wound thereon; and reading said marker at said rewinding machine for identifying defective spinning positions.

2. The method of claim 1, further comprising the step of writing the marker at the spinning positions and thereby storing on said cops the spinning position of each cop.

3. The method of claim 1, wherein an end section of said yarn is dyed.

4. The method of claim 1, further comprising the steps of:

determining a yarn quality in said rewinding machine; and using said markers for attributing said yarn quality to one of said spinning positions.

* * * * *